United States Patent [19]

Lasenby et al.

[11] Patent Number: 5,056,662

[45] Date of Patent: Oct. 15, 1991

[54] WIDE ABRASIVE BELT CARTON

[75] Inventors: Kyle D. Lasenby, Eagan; John J. Frautschi, Minneapolis, both of Minn.

[73] Assignee: Minnesota Mining and Manufacturing Company, St. Paul, Minn.

[21] Appl. No.: 543,693

[22] Filed: Jun. 26, 1990

[51] Int. Cl.[5] ..... B65D 85/67

[52] U.S. Cl. ..... 206/395; 206/408; 206/413; 206/608; 225/48; 225/106

[58] Field of Search ..... 206/395, 407, 408, 413, 206/415, 605, 608, 634, 416; 225/48, 50, 106

[56] References Cited

U.S. PATENT DOCUMENTS

| | | | |
|---|---|---|---|
| 952,263 | 3/1910 | Kreuzkamp et al. | 206/408 |
| 1,114,660 | 10/1914 | West | 206/407 |
| 1,143,103 | 6/1915 | Cameron . | |
| 1,853,499 | 4/1932 | Boeye . | |
| 1,940,292 | 12/1933 | Bueschel | 229/29 |
| 2,459,939 | 1/1949 | Hill et al. | 229/36 |
| 2,607,476 | 8/1952 | Rockerfeller | 206/408 |
| 2,671,601 | 3/1954 | Leavitt | 229/23 |
| 2,708,545 | 5/1955 | Seith | 229/51 |
| 2,766,923 | 10/1956 | D'Esposito | 229/23 |
| 2,868,431 | 1/1959 | Painter | 229/51 |
| 3,132,792 | 5/1964 | Minion | 229/23 |
| 3,344,976 | 10/1967 | Mason | 229/51 |
| 3,421,679 | 1/1969 | Goldman | 229/15 |
| 3,506,184 | 4/1970 | Barnes | 206/408 |
| 3,581,973 | 6/1971 | Turpin | 229/37 |
| 3,796,305 | 3/1974 | Beason | 206/407 |
| 3,891,137 | 6/1975 | Ellison et al. | 229/44 R |
| 3,942,637 | 3/1976 | Glennie | 206/389 |
| 3,998,326 | 12/1976 | McKee, Jr. | 206/407 |
| 4,679,694 | 7/1987 | Donohie et al. | 206/605 |
| 4,823,956 | 4/1989 | Belisle | 206/407 |

FOREIGN PATENT DOCUMENTS

| | | | |
|---|---|---|---|
| 2115976 | 3/1973 | Fed. Rep. of Germany | 206/415 |

OTHER PUBLICATIONS

"Fibre Box Handbook, An illustrated reference for manufacturers and users of shipping containers," *Stone Container Corporation, Corrugated Container Division* (Fibre Box Association, 1987).

*Primary Examiner*—David T. Fidei

*Attorney, Agent, or Firm*—Gary L. Griswold; Walter N. Kirn; Jeffrey J. Hohenshell

[57] ABSTRACT

The present invention provides in association, a plurality of endless abrasive belts wound about an axis into a coil, and a two-way opening packaging carton for enclosing and protecting the plurality of endless abrasive belts. The carton may be opened from the top or from an end. A pair of pads inside the carton are used to protect the abrasive belts. The carton is a versatile article which may be stored in various arrangements and may be used to store belts even after it is opened.

17 Claims, 5 Drawing Sheets

WIDE ABRASIVE BELT CARTON

TECHNICAL FIELD

The present invention relates generally to cartons for enclosing and protecting coils of wide endless abrasive belts.

BACKGROUND

An endless abrasive belt comprises a continuous backing which may be of plastic, paper, cloth or any other suitable material having an abrasive material bonded on one surface. Endless coated abrasive belts that have widths greater than 36 cm (14 inches) are referred to as "wide belts".

Wide belts having a width of 127 cm (50 inches) are commonly used in leveling surfaces in lumber planing and particle board and plywood finishing. Several of those endless coated abrasive belts are wrapped together in a coil by the manufacturer and placed in one carton, and several of such cartons are stacked on a pallet and sent to the user who removes the belts from the cartons as they are needed. If a discontinuity is formed in the belt by the belt being cut, creased, kinked, crinkled, cracked or damaged in any other way, that discontinuity can cause an imperfection on an abraded workpiece, such as a deep scratch on a wood workpiece which is accented if the wood is stained.

Due to the relatively long length and wide width of wide abrasive belts, they are difficult to handle and it is common for an operator to accidentally damage a belt, particularly along its edges, while the belt is being removed from a carton.

Known prior art cartons in which such wide abrasive belts are shipped to a user can either only be opened from an end or can only be opened from a side or "top". When cartons that can only be opened from a side or "top" are stored in a stack, a user must remove all the cartons above a desired carton in the stack in order to open it, which can be difficult since a carton full of such endless wide belts can weigh about seventy pounds.

Similarly, removing belts from cartons that can only be opened from an end that are located on a floor or a worktable is difficult for a single workman, and typically requires a second workman to hold the carton while the coil of abrasive belts is slid longitudinally from the carton. If a workman attempts to open a side of an end opening carton or the end of a side opening carton with a hand knife or box cutter, the knife or box cutter could damage the belts. Such difficulties in removing wide abrasive belts from known cartons increases the possibility that a wide belt will be damaged by a workman.

DISCLOSURE OF THE INVENTION

The present invention provides a carton for enclosing and protecting a coil of wide endless abrasive coated belts which facilitates removal of an abrasive coated belt by a workman, thereby helping to restrict damage to abrasive coated belts being removed.

According to the present invention, there is provided a packaging carton comprising an elongate box including four elongate side walls joined along opposite edges to the edges of two of the other side walls to form a tubular main portion of the box, an end wall disposed generally radially of the axis and attached to the side walls to permanently close a second end of the tubular main portion of the box, and a plurality of flaps integral with the side walls at their ends opposite the end wall which can be bent along fold lines between closed positions where they can be retained by tape with the flaps disposed to close the first end of the tubular main portion, and open positions spaced from the first end of the tubular main portion to afford removal of the abrasive belts axially of the tubular main portion of the box. The carton also includes manually operable means extending axially along one of the side walls for affording manual separation of that side wall into two portions that can be bent to a position affording removal of abrasive belts from the container assembly between the portions. Also, to help protect the edges of a coil of abrasive coated belts, a fixed resilient compressible protective pad is permanently attached along the inner surface of the end wall, and a removable resilient compressible protective pad is adapted to be removably positioned adjacent the flaps.

When the carton is stacked below other cartons on a pallet, the flaps at the end of the carton can be opened and the weight of the cartons above the desired carton will hold the carton while a single user slides the endless belts longitudinally from the carton. Alternatively, if the carton is positioned on the floor or on a worktable, a workman can remove the belts through the side or "top" of the carton rather than from its end.

Preferably, the manually operable means extending axially along one of the side walls for affording manual separation of that side wall into portions comprises first and second tear tape strips extending axially and centrally along the inner surface of the one side wall. The first tear tape strip extends from the end of the one side wall adjacent the flaps to a middle portion of the side wall and the second tear tape strip extends from the second end of the one side wall to a middle portion of the side wall. The ends of the tear tape strips at the middle portion of the side wall are attached to first and second tabs formed by U-shaped slits in the side wall and used as handles which can be pried upward, grasped and manually drawn upward to pull the tear tape strips through the one side wall to separate it into the two portions.

The material used to fabricate the one side wall is a conventional corrugated board material formed from first and second parallel sheets with a corrugated sheet sandwiched therebetween. It is common in the packaging art to orient the flutes in the corrugated sheet of such corrugated board material in a direction parallel to the direction of loading and unloading, and thus, for an end opening carton, the flute direction would conventionally be parallel to the longitudinal axis of the box. The flute direction of the present invention is, however, placed perpendicular to longitudinal axis of the box which provides both excellent compression strength for the box and ensures a clean tear by the tear tape strips through the one side wall.

BRIEF DESCRIPTION OF THE DRAWING

The present invention will be further described with reference to the accompanying drawing wherein like reference numerals refer to like parts in the several views, and wherein.

DETAILED DESCRIPTION

Figure 7:
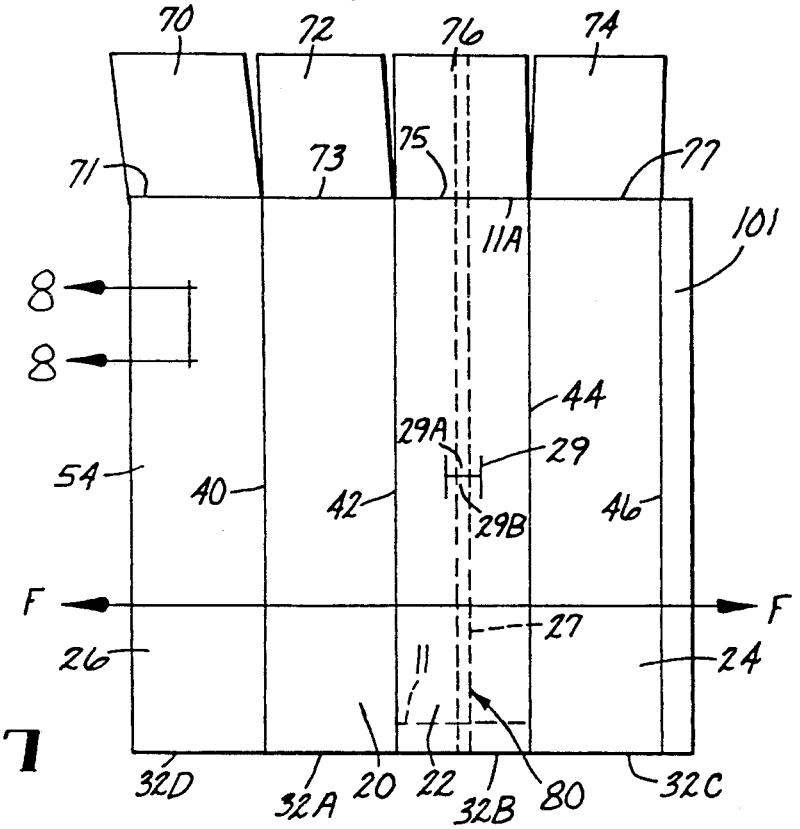
FIG. 7 illustrates a flat blank from which a box included in the packaging carton of FIG. 1 is assembled.

Referring now to the drawings, there is shown a two-way opening packaging carton 10 according to the present invention for enclosing and protecting a plurality of endless abrasive belts 14 wound about an axis into a coil having axially spaced edges 13 and 15. The packaging carton comprises an elongate box 12 having a longitudinal axis A (FIG. 3) and including four elongate side walls 20, 22, 24 and 26. Each of the four elongate side walls 20, 22, 24 and 26 has a first end 30A, 30B, 30C, or 30D and a second end 32A, 32B, 32C or 32D and is joined along its opposite edges 40, 42, 44 and 46 to the edges of two other side walls to form a tubular main portion 50 (FIG. 3) of the box 12. Preferably, as illustrated in FIG. 7, the edges 40, 42, 44 and 46 between all but two of the side walls 20, 22, 24 and 26 are joined by being portions of the same piece of stock (FIG. 7) that is scored and bent along the edges 40, 42, 44 and 46, whereas the edges of the side walls 20 and 26 are joined by a tab 101 (FIG. 4) adhered along the outer surface 54 of side wall 26 (see FIG. 7).

Figure 3:
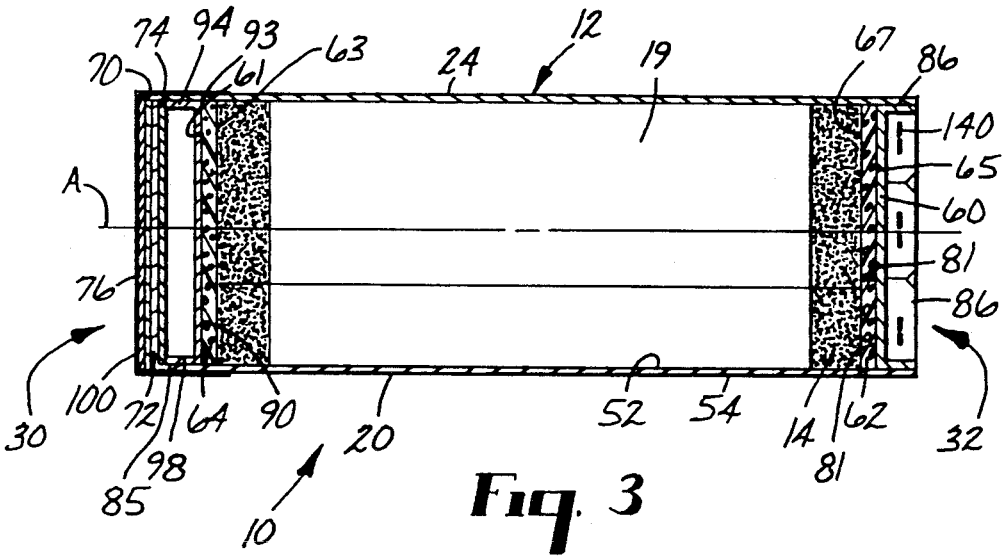
FIG. 3 is an enlarged cross-section of the carton of FIG. 1 taken approximately along line 3—3 of FIG. 1.
Figure 4:
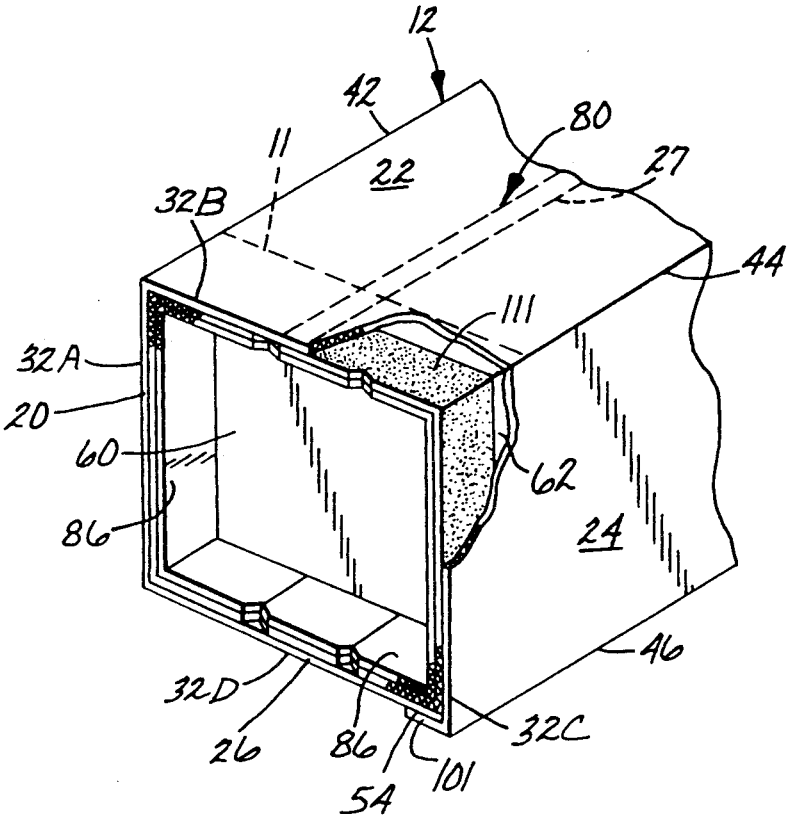
FIG. 4 is an enlarged perspective fragmentary view of an end of the carton of FIG. 1 having portions broken away to show details.

Near the second ends 32A, 32B, 32C and 32D of the side walls 20, 22, 24 and 26 is an end wall 60 disposed generally radially of the axis A and attached adjacent the second ends 32A, 32B, 32C and 32D to the side walls 20, 22, 24 and 26 to permanently close the second end 32 of the tubular main portion 50 of the box 12. The end wall 60 has an inner surface 81 adjacent the inner surface 52 of the main portion 50 of the box 12. The end wall 60 has flanges 86 around its periphery that are fixedly attached along the inner surfaces 52 of the side walls 20, 22, 24 and 26 adjacent their second ends 32A, 32B, 32C and 32D by use of affixing means such as stitching (not shown), staples 140 (FIG. 3) or an adhesive layer 111 (FIG. 4).

Figure 1:
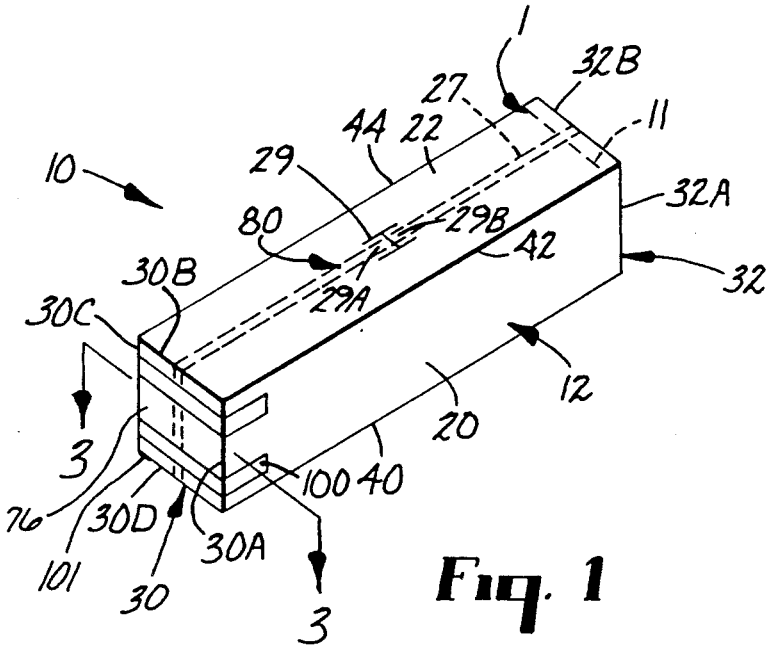
FIG. 1 is a perspective view of a carton according to the present invention when it is closed.
Figure 2:
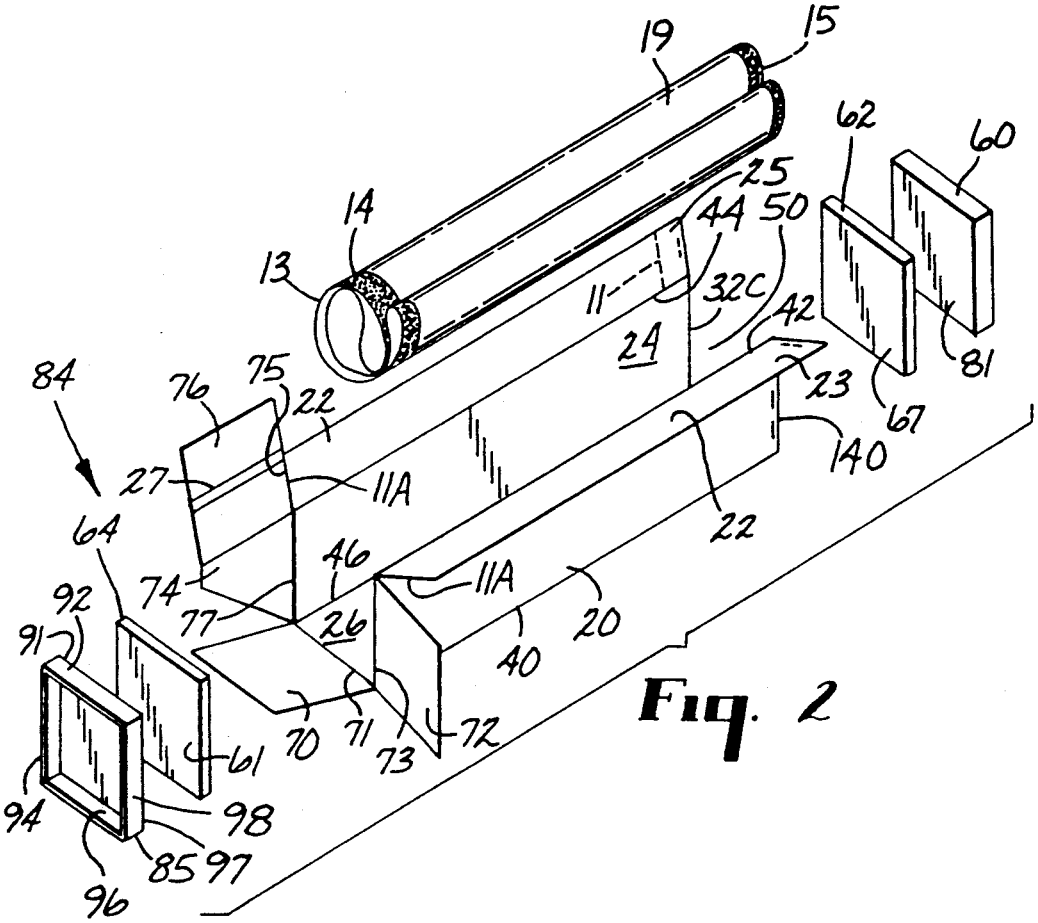
FIG. 2 is an exploded perspective view of the carton of FIG. 1 together with a coil of abrasive belts it is adapted to enclose.

On the first ends 30A, 30B, 30C and 30D of the side walls 20, 22, 24 and 26 of the box 12 are four flaps 70, 72, 74 and 76, each being integral with a different one of the side walls 20, 22, 24 and 26 along fold lines 71, 73, 75 and 77. The fold lines 71, 73, 75 and 77 are perpendicular to the longitudinal axis A of the box 12 and the flaps 70, 72, 74 and 76 are movable by being bent along the fold lines 71, 73, 75 and 77 between a closed position (FIGS. 1, 3 and 5) with the flaps 70, 72, 74 and 76 being disposed about radially and perpendicular to the longitudinal axis A across the first end 30 of the tubular portion 50, and an open position (FIGS. 2 and 6) spaced from the first end 30 of the tubular portion 50.

Extending axially along side wall 22 are manual separation means 80 including tear tape 27 for affording manual separation of side wall 22 into first 23 and second 25 rectangular portions pivotal about the edges 42 and 44 of side wall 22 to a position affording removal of abrasive belts 14 from the carton 10 between the rectangular portions 23 and 25.

A fixed resilient compressible protective pad 62 (e.g. approximately 1.5 cm, ⅝ inch thick polyethylene) adapted to conform to and protect one edge 15 of the coil of endless abrasive belts 14 has a rear surface 65 attached along the inner surface 81 of the end wall 60. There is also provided a similar removable resilient compressible protective pad 64 which similarly is adapted to conform to the other edge 13 of the coil of endless abrasive belts 14, together with means 84 for removably positioning the removable resilient compressible protective pad 64 adjacent the first ends 30A, 30B, 30C and 30D of the side walls 20, 22, 24 and 26 with a front surface 63 of the removable pad 64 facing a front surface 67 of the fixed pad 62. The pads 62 and 64 resiliently deform against the edges 13 and 15 of the abrasive belts 14 to support and cushion the edges 13 and 15 of the abrasive belts 14 against collisions with end wall 60 and pad support member 85. By resiliently deforming against the edges of the abrasive belts 14, the pads 62 and 64 hold the coil of belts 14 in a centered position and prevent the middle of the belts 14 from collapsing.

The means 84 for removably positioning the removable resilient compressible protective pad comprises a pad support member 85 including a support wall portion having a major surface 90 (FIG. 3) to which a rear surface 61 of the removable pad 64 is adhered. The support wall portion has edges 91, 93, 95 and 97 around the major surface 90 adapted to be positioned closely adjacent to the inner surface 52 of the main portion 50 of the box with the major surface 90 of the support wall positioned generally radially of the tubular main portion 50. The pad support member 85 further has a plurality of flanges 92, 94, 96 and 98 located along the edges 91, 93, 95 and 97, and positioned along the inner surface 52 of the main portion 50. The edges 91, 93, 95 and 97 may be scored into a flat blank (not shown). The flat blank used to assemble pad support member 85 may be identical to the blank used to assemble end wall 60. The rear major surface 61 of the removable resilient compressible protective pad 64 is attached along the major surface 90 of support member 85.

The outermost flap 76 of the plurality of flaps 70, 72, 74 and 76 is secured in the closed position by tape means, such as two strips 100 of #355 clear sealing tape available from Minnesota Mining and Manufacturing Co. (3M). The tape strips 100 hold the flaps 70, 72, 74 and 76 in the closed position during transportation and storage of the carton 10. When the flaps 70, 72, 74 and 76 are closed, the innermost flap 74 abuts the flanges 92, 94, 96 and 98 of the pad support member 85 to securely hold it and thereby the abrasive belts 14 in place (FIG. 3). The pads 62 and 64 resiliently deform against the edges 13 and 15 of the belt abrasives 14 to thereby support and cushion the edges 13 and 15 of the abrasive belts. To release the tape strips 100 when the carton is opened at the first end 30, a knife may be used to cut the tape strips 100.

In addition to the tear tape 27, the manual separation means 80 comprises means 1 extending transversely across the side wall 22 adjacent to its second 32B end to facilitate the pivoting of the first and second rectangular portions 23 and 25, and a perforation line 11A on the fold line 75 of flap 76. The inclusion of perforation line 11A creates a carton which is easy to open as a user is not required to tear through the flap 76.

Figure 5:
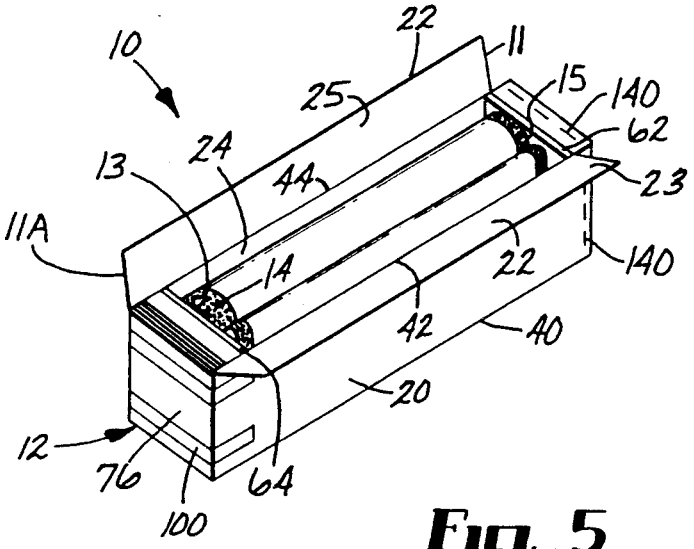
FIG. 5 is a perspective view of the carton showing the carton opened from the top to gain access to the abrasive belts.

The means 1 extending transversely across the side wall 22 may comprise a perforation line 11 near the second end 32B of side wall 22 as is illustrated in FIG. 5, in which case the end wall 60 is attached to the inner portion 52 of the tubular main portion 50 of the box 12 by means of staples 140, and the perforation line 11 is located on the side wall 22 inside of the staples 140.

As an alternative to such a perforation line 11, the means 1 extending transversely across the side wall 22 may comprise an adhesive layer 111 located on the flanges 86 of the end wall 60 and the inner surface 52 of the second ends 32A, 32B, 32C and 32D of the side walls 20, 22, 24 and 26, and adapted to permit the first and second rectangular portions 23 and 25 to detach from the end wall 60 without destroying the first and second rectangular portions 23 and 25. The adhesive, however, should also be sufficiently aggressive to keep the side wall 22 attached to the end wall 60 before the container is opened. An example of a suitable adhesive is Jet Melt Adhesive #3762-AE available from Minnesota Mining and Manufacturing Co. (3M).

The tear tapes 27 included in the manual separation means 80 extend axially and centrally along the inner surface 52 of the side wall 22. A first tear tape strip 27 extends from the first end 30B of the side wall 22 to a centrally located tab 29A on the side wall 22 and a second tear tape strip 27 extends from the second end 32B of the side wall 22 to another centrally located tab 29B on the side wall 22. The tabs 29A and 29B, which are formed by U-shaped slits through the side wall 22, provide handles 29 centrally located along the side wall 22. To open the carton from the top, the user grasps the handles 29 or tabs 29A and 29B and pulls the tear tape 27 upward through side wall 22 to separate the side wall into the first and second rectangular portions 23 and 25. Once separated, the first and second rectangular portions 23 and 25 are pivoted along the opposite edges 42 and 44 to afford access to the belts 14. Alternatively, the manual opening means 80 may comprise a perforation line extending axially and centrally along the center of side wall 22.

During manufacture of the carton 10, the construction of the first and second tear tape strips 27 may be achieved by placing a single tear tape strip on the inner surface 52 of the blank (FIG. 7) and thereafter cutting the U-shaped slits in the side wall 22 to form the tabs 29A and 29B.

When the carton is opened at the first end 30, the tape strips 100 are cut with a knife, the flaps 70, 72, 74 and 76 are placed in the open position, and the pad support member 85 is removed by grasping it at grasping means provided by the flanges 92, 94, 96 and 98 or a finger hole (not shown) in the pad support member 85.

Once the carton 10 is opened from the first end 30, the carton may be closed again without substantially affecting the structural integrity of the carton. The pad support member 85 is not destroyed when it is removed from the first end 30 of the carton 10, and can be replaced in the inner portion 52 along the edge 13 of the remaining abrasives in the coil 14. After the pad support member 85 is replaced, the carton 10 is closed by using additional tape strips on the outermost flap 76. Thus, the carton of the present invention is particularly suitable for storing belts event after the carton is opened.

Figure 6:
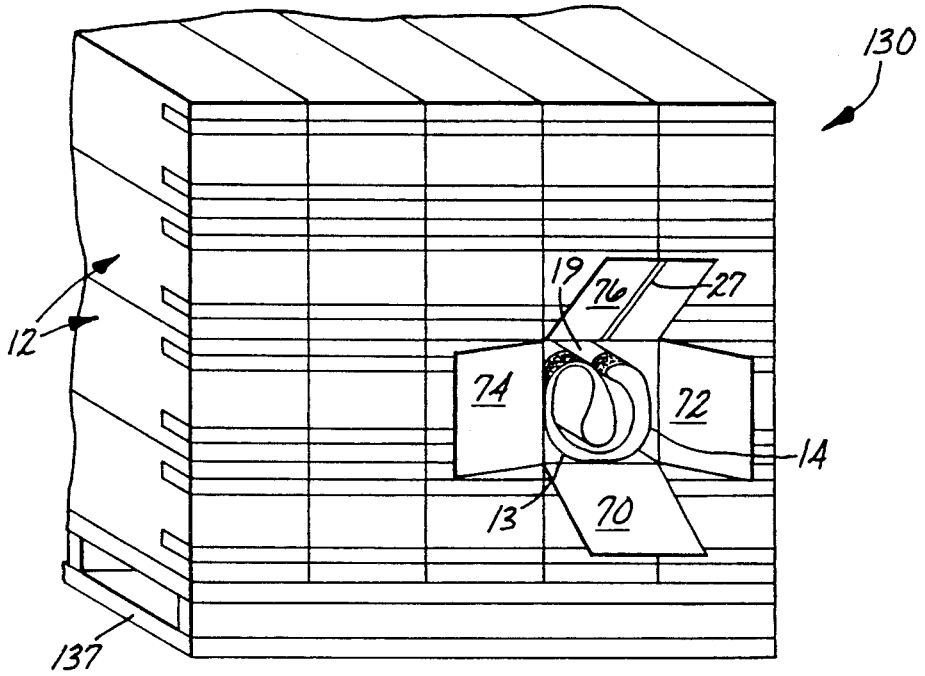
FIG. 6 is a perspective view of a plurality of packaging cartons of the type shown in FIG. 1 stacked on a pallet and showing a carton opened from an end to gain access to the coil of abrasive belts.

In the workplace several cartons 130 may be stacked on a wooden pallet 137 as illustrated in FIG. 6, and may contain abrasive belts coated with different grades of abrasives. As illustrated in FIG. 6, a workman need not remove cartons 130 above a carton containing a desired grade of abrasive belts 14, since the cartons 130 can be opened from their ends. The weight of the cartons 130 above a carton that is opened will hold the carton while a single workman slides the endless belts 14 longitudinally from the rectangular box 12. At the same time, the carton includes the means 80 for opening the carton from the top according to the user's preference.

Figure 8:
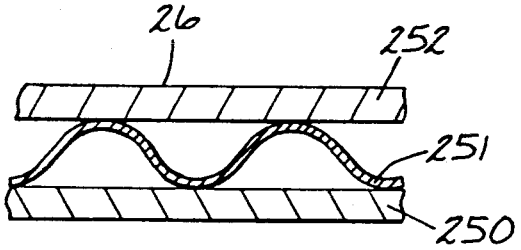
FIG. 8 is an enlarged cross-sectional view taken approximately along line 8—8 of FIG. 7.

To assemble the carton from the blank (FIG. 7), the blank is bent along edges 40, 42, 44 and 46 to form the four side walls 20, 22, 24 and 26, and the tab portion 101 along side wall 20 at edge 40 is attached to the outer surface 54 of the bottom side wall 26 by staples, stitching or with an adhesive layer 111 (FIG. 4). A material (FIG. 8) used to fabricate the carton 10 comprises a #275 Mullen strength, double faced corrugated board material including first 250 and second 252 parallel sheets and a C type "flute" (approximately 39 flutes per foot and 9/64 inches in height) or corrugation sheet 251 having a flute direction F perpendicular to the page. The corrugated sheet 251 is sandwiched between the first and second parallel sheets 250 and 252 and the flute direction F is perpendicular to the longitudinal axis A of the carton 10.

A flute direction F perpendicular to the longitudinal axis A of the carton 10 was found to exhibit excellent compression strength when compared with a carton having a flute direction parallel to the longitudinal axis of the carton. Thus, a carton 10 of the present invention on the bottom of stack 130 (FIG. 6) has a greater capacity to withstand the weight of the cartons above. Also, when tear tape 27 is used as the manual separation means 80, then the flute direction F should be perpendicular to the longitudinal axis A of the carton 10 to ensure a clean tear through wall 22. If the flute direction F is parallel to the longitudinal axis A of the carton 10, then the tear tape 27 tends to rip the top sheet 252 of the material from the corrugated board 251.

Figure 9:
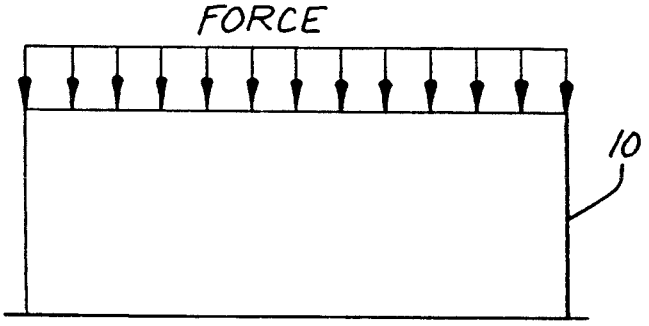
FIG. 9 is a representation of a compression test performed on the carton according to the present invention and another carton.

FIG. 9 is a representation of a standard compression test for shipping containers performed on the carton of the present invention and a prior art carton. The test performed was ASTM test D 642-76(Reapproved 1983). Both the prior art carton (B) and the carton 10 (A) according to the present invention utilized end caps. In contrast to the carton of the present invention which is accessible both at the top and the end, the prior art carton was an end opening carton only.

The following table describes the test samples:

TABLE 1

| Test Sample | Side Characteristics | End Caps |
|---|---|---|
| A (Present Invention) Lateral Flute Direction | #275 (Mullen test strength); C type flute, single wall corrugated (double faced) | #275; B/C type flutes, double wall corrugated; with adhered protective pads |
| B Test Box Longitudinal Flute | #275; B/C; double wall corrugated | #275; B/C; double |

TABLE 1-continued

| Test Sample | Side Characteristics | End Caps |
|---|---|---|
| Direction | | wall corrugated |

A double wall corrugated material has three parallel sheets and two corrugated boards or "flutes" sandwiched therebetween. A "B" type flute has approximately 47 flutes per foot and has a height of about 3/32 of an inch. The following table illustrates the results of the test:

TABLE II

ASTM COMPRESSION TEST FOR SHIPPING CONTAINERS D 642-76
Preload: 50 lbs
Record Rate: every 0.1 in
Speed(Platen) 0.5 in/min

| | Deflection (in.) | | Load (lbs.) | |
|---|---|---|---|---|
| Time (min.) | Box B Prior Art/ | Box A Present Invention | Box B Prior Art/ | Box A Present Invention |
| 0:06 | .030 | .049 | 92.7 | 125.3 |
| 0:11 | .078 | .088 | 139.8 | 193.4 |
| 0:15 | .107 | .127 | 171.4 | 284.3 |
| 0:20 | .146 | .165 | 212.7 | 416.2 |
| 0:25 | .194 | .204 | 280.4 | 598.2 |
| 0:31 | .243 | .253 | 357.7 | 906.7 |
| 0:35 | .272 | .292 | 403.9 | 1,286.4 |
| 0:36 | .281 | .301 | 424.6 | 1,377.8 |
| 0:38 | .301 | .310 | 458.8 | 1,456.0 |
| 0:40 | .310 | .330* | 475.5 | 1,474.9* |
| 0:41 | .320 | .339 | 490.0 | 1,441.1 |
| 0:42 | .330 | .349 | 505.9 | 1,435.8 |
| 0:45 | .359 | .368 | 565.6 | 896.1 |
| 0:50 | .397 | .417 | 658.8 | 672.4 |
| 0:55 | .436 | .455 | 752.9 | 662.3 |
| 1:00 | .484 | .494 | 865.4 | 519.9 |
| 1:02 | .494 | .513 | 888.7 | 486.1 |
| 1:03 | .505 | .523 | 916.3 | 479.0 |
| 1:04 | .513* | .533 | 923.4* | 471.1 |
| 1:06 | .533 | .542 | 912.0 | 460.6 |
| 1:08 | .542 | .562 | 903.6 | 418.8 |
| 1:10 | .562 | .582 | 900.1 | 408.3 |
| 1:12 | .581 | .591 | 898.3 | 404.8 |

Asterisks in Table II identify point X, which is the point where carton A endured the greatest compression force (1,474.9) and point Y, which is the point where carton B endured its greatest compression force (923.4 pounds). The prior art carton endured a force of approximately 923.4 pounds while the carton of the present invention endured a force of approximately 1,474.9 pounds.

Figure 10:
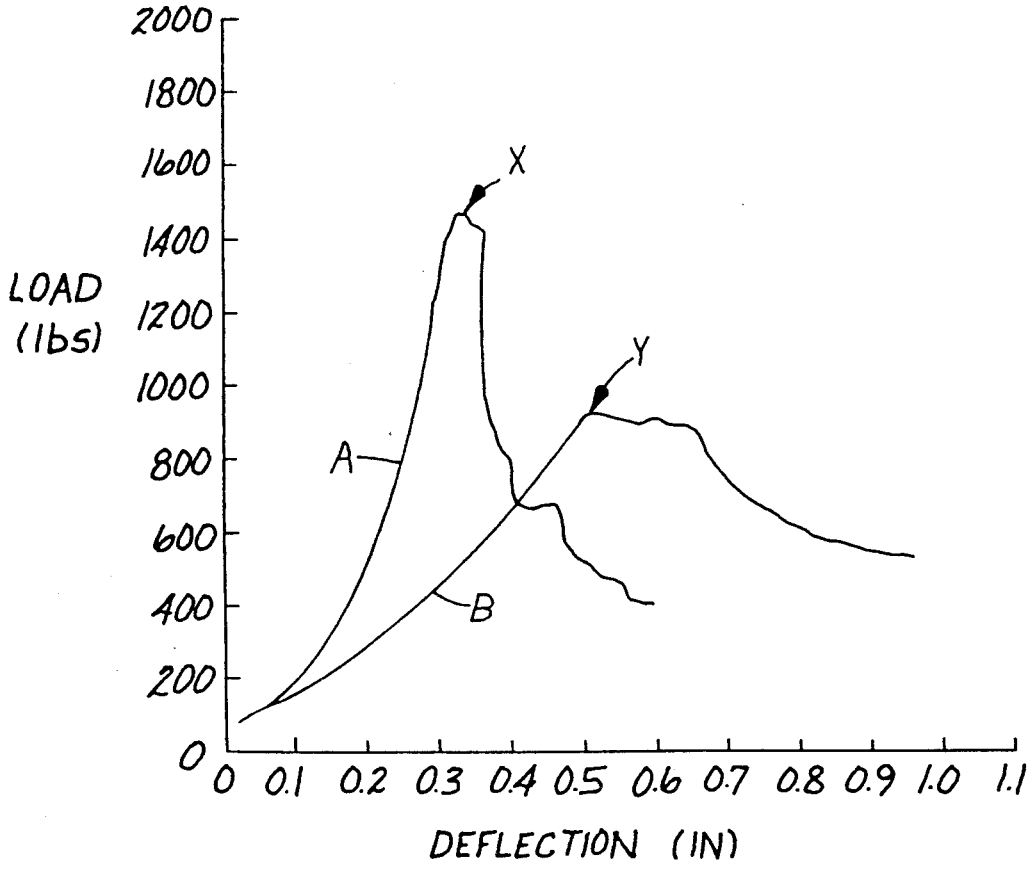
FIG. 10 is a graphical representation of the results of the test illustrated in FIG. 9.

It should be noted that the single wall corrugated material used to make the carton of the present invention is less expensive than the double wall corrugated material used to construct the prior art carton, yet, as shown in FIG. 10, carton A exhibited superior compression strength characteristics relative to carton B. The additional strength of carton A may be utilized, for example, to facilitate higher stacking of cartons.

In FIG. 10, the force is shown along the ordinate (y-axis) while the deflection is represented along the abscissa (x-axis). The results of the test show that the carton of the present invention has superior compression strength when compared with the prior art box.

The present invention has now been described with reference to several embodiments thereof. It will be apparent to those skilled in the art that many changes or additions can be made in the embodiments described without departing from the scope of the present invention. For example, when the present invention includes the perforation line 11, the end wall 60 may include attachment means such as a relatively aggressive adhesive (not shown), stitching (not shown) or staples 140. Additionally, there may be present a kraft paper wrap 19 to protect the belt abrasives 14 from damage. Also, the carton 10 of the present invention may be used without the pads 62, 64 when the endless abrasive belts 14 are wound about a core. It will also be apparent that the blank shown in FIG. 7 is particularly suitable for use with endless abrasive belts 14 of various sizes as the blank may be cut perpendicular to the longitudinal axis A near the second end 32 to accommodate belts 14 of different widths. Thus, the scope of the present invention should not be limited to the structures described in this application, but only by structures described by the language of the claims and the equivalents of those structures.

What is claimed is:

1. A two-way opening packaging carton for enclosing and protecting a plurality of endless abrasive belts wound about an axis into a coil having axially spaced edges, the packaging carton comprising:

an elongate box including walls comprising:

four elongate side walls each having opposite first and second ends and opposite edges, each of said side walls being joined along said edges to the edges of two other of said side walls to form a tubular main portion of said box having a longitudinal axis, first and second ends, and inside and outside surfaces;

an end wall disposed generally radially of said axis and attached adjacent the second ends of said side walls to close the second end of said tubular main portion of said box, said end wall having an inner surface adjacent the inner surface of said main portion of said box;

a plurality of flaps each being integral with a different one of said side walls, being joined to the side wall at said first end along a fold line perpendicular to said longitudinal axis of said tubular main portion, and being movable by being bent along said fold line between a closed position with the flap being disposed about radially of said longitudinal axis to close the first end of said tubular main portion, and an open position spaced from the first end of said tubular main portion to afford removal of the abrasive belts axially of the main portion of the box;

manual opening means extending axially along one of said side walls and transversely across said one side wall adjacent at least one of said first and second ends for affording manual separation of said one side wall into first and second portions pivotal to a position affording removal of abrasive belts from said container assembly between said portions;

a fixed resiliently compressible protective pad adapted to conform to one edge of the coil of endless abrasive belts, said protective pad having a rear major surface attached along the inner surface of said end wall and an opposite front surface;

a removable resiliently compressible protective pad adapted to conform to the other edge of the coil of endless abrasive belts, said removable protective pad having front and rear major surfaces; and means for removably positioning said removable resiliently compressible protective pad adjacent the second ends of said side walls with the front surface of the removable pad facing the front surface of the fixed pad.

2. A carton according to claim 1 wherein said means for removably positioning said removable resiliently compressible protective pad comprises a pad support member including a support wall portion having a major surface, edges around said major surface adapted to be positioned closely adjacent the inner surface of said main portion of the box with the major surface of said support wall positioned generally radially of said main portion, and a plurality of flanges at said edges adapted to project generally normally past said major surface of said support wall and to be positioned along the inner surface of said main portion, the rear major surface of said removable resiliently compressible protective pad being attached along the major surface of said support wall.

3. A carton according to claim 2 wherein said pad support member has grasping means adapted to allow a user to grasp said pad support member.

4. A carton according to claim 1 wherein said manual opening means extending transversely across said one side wall adjacent at least one of said first and second ends are perforation lines.

5. A carton according to claim 1 wherein said manual opening means extending transversely across said one side wall adjacent at least one of said first and second ends further comprises an adhesive located on the inner surface of said one side wall at said second end which adhesive is adapted to afford separation of said one side wall from said end wall, and a perforation line located on said one side wall at said first end along said flap fold line.

6. A carton according to claim 1 wherein said walls are formed of a double faced corrugated board material, said double faced corrugated board material comprising first and second parallel sheets and a corrugated sheet having elongate corrugations attached between said first and second sheets, said corrugations being aligned perpendicular to the longitudinal axis of said tubular main portion.

7. A carton according to claim 1 wherein said manual opening means extending axially along one of said side walls comprises:

said one side wall having first and second U-shaped slits located on a central portion of said one side wall and defining first and second tabs each having an end surface, said end surfaces being located adjacent each other, and a first tear tape strip extending along the inside surface of said one side wall generally from the fold line of said one side wall to the end surface of said first tab and a second tear tape strip extending along the inside surface of said one side wall from the second end of said one side wall to the end surface of said second tab, said first and second tabs providing handles centrally located along said one side wall for pulling the first and second tear tape strips upward from the inside surface of said one side wall toward the outside surface of said one side wall to thereby open the carton.

8. A carton according to claim 1 wherein when said plurality of flaps integral with a different one of said side wall are in said closed position the outermost flap of the plurality of flaps is secured in said closed position by a piece of adhesive coated tape.

9. In combination a plurality of endless belts wound about an axis into a coil having axially spaced edges, and a two-way opening packaging carton for enclosing and protecting said plurality of endless abrasive belts, the packaging carton comprising:

an elongate box including walls comprising four elongate side walls each having opposite first and second ends and opposite edges, each of said side walls being joined along said edges to the edges of two other of said side walls to form a tubular main portion of said box having a longitudinal axis, first and second ends, and inside and outside surfaces;

an end wall disposed generally radially of said axis and attached adjacent the second ends of said side walls to close the second end of said tubular main portion of said box, said end wall having an inner surface adjacent the inner surface of said main portion of said box;

a plurality of flaps each being integral with a different one of said side walls, being joined to the side wall at said first end along a fold line perpendicular to said longitudinal axis of said tubular main portion, and being movable by being bent along said fold line between a closed position with the flap being disposed about radially of said longitudinal axis to close the first end of said tubular main portion, and an open position spaced from the first end of said tubular main portion to afford removal of the abrasive belts axially of the main portion of the box, and manually removable means for retaining said flaps in said closed position;

manual opening means extending axially along one of said side walls and transversely across said one side wall adjacent at least one of said first and second ends for affording manual separation of said one side wall into first and second portions pivotal to a position affording removal of abrasive belts from said container assembly between said portions;

a fixed resiliently compressible protective pad adapted to conform to one edge of the coil of endless abrasive belts, said protective pad having a rear major surface attached along the inner surface of said end wall and an opposite front surface;

a removable resiliently compressible protective pad adapted to conform to the other edge of the coil of endless abrasive belts, said removable protective pad having front and rear major surfaces; and means for removably positioning said removable resiliently compressible protective pad adjacent the second ends of said side walls with the front surface of the removable pad facing the front surface of the fixed pad.

10. A combination according to claim 9, wherein said means for removably positioning said removable resiliently compressible protective pad comprises a pad support member including a support wall portion having a major surface, edges around said major surface adapted to be positioned closely adjacent the inner surface of said main portion of the box with the major surface of said support wall positioned generally radially of said main portion, and a plurality of flanges at said edges adapted to project generally normally past said major surface of said support wall and to be positioned along the inner surface of said main portion, the rear major surface of said removable resiliently compressible protective pad being attached along the major surface of said support wall.

11. A combination according to claim 10, wherein said pad support member has grasping means adapted to allow a user to grasp said pad support member.

12. A combination according to claim 9, wherein said manual opening means extending transversely across said one side wall adjacent at least one of said first and second ends are perforation lines.

13. A combination according to claim 9, wherein said manual opening means extending transversely across said one side wall adjacent at least one of said first and second ends further comprises an adhesive located on the inner surface of said one side wall at said second end which adhesive is adapted to afford separation of said one side wall from said end wall, and a perforation line located on said one side wall at said first end along said flap fold line.

14. A combination according to claim 9, wherein said walls are formed of a double faced corrugated board material, said double faced corrugated board material comprising first and second parallel sheets and a corrugated sheet having elongate corrugations attached between said first and second sheets, said corrugations being aligned perpendicular to the longitudinal axis of said tubular main portion.

15. A combination according to claim 9, wherein said manual opening means extending axially along one of said side walls comprises:

said one side wall having first and second U-shaped slits located on a central portion of said one side wall and defining first and second tabs each having an end surface, said end surfaces being located adjacent each other, and a first tear tape strip extending along the inside surface of said one side wall generally from the fold line of said one side wall to the end surface of said first tab and a second tear tape strip extending along the inside surface of said one side wall from the second end of said one side wall to the end surface of said second tab, said first and second tabs providing handles centrally located along said one side wall for pulling the first and second tear tape strips upward from the inside surface of said one side wall toward the outside surface of said one side wall to thereby open the carton.

16. A combination according to claim 9, wherein said manually removable means for retaining said flaps in said closed position is a length of adhesive coated tape.

17. A two-way opening packaging carton for enclosing and protecting a plurality of endless abrasive belts wound about an axis into a coil having axially spaced edges, the packaging carton comprising:

an elongate box including walls comprising:

four elongate side walls each having opposite first and second ends and opposite edges, each of said side walls being joined along said edges to the edges of two other of said side walls to form a tubular main portion of said box having a longitudinal axis, first and second ends, and inside and outside surfaces;

a fixed end wall disposed generally radially of said axis and attached adjacent the second ends of said side walls to close the second end of said tubular main portion of said box, said fixed end wall having an inner surface adjacent the inner surface of said main portion of said box;

a plurality of flaps each being integral with a different one of said side walls, being joined to the side wall at said first end along a fold line perpendicular to said longitudinal axis of said tubular main portion, and being movable by being bent along said fold line between a closed position with the flap being disposed about radially of said longitudinal axis to close the first end of said tubular main portion, and an open position spaced from the first end of said tubular main portion to afford removal of the abrasive belts axially of the main portion of the box;

manual opening means extending axially along one of said side walls and transversely across said one side wall adjacent at least one of said first and second ends for affording manual separation of said one side wall into first and second portions pivotal to a position affording removal of abrasive belts from said container assembly between said portions;

a removable end wall having front and rear major surfaces; and means for removably positioning said removable end wall adjacent the second ends of said side walls with the front surface of the removable end wall facing the front surface of the fixed end wall.

* * * * *

UNITED STATES PATENT AND TRADEMARK OFFICE

CERTIFICATE OF CORRECTION

PATENT NO. : 5,056,662

DATED : October 15, 1991

INVENTOR(S) : Kyle D. Lasenby and John J. Frautschi

It is certified that error appears in the above-indentified patent and that said Letters Patent is hereby corrected as shown below:

Col. 10, line 1, after "endless" insert --abrasive--.

Signed and Sealed this

Third Day of May, 1994

Bruce Lehman

*Attest:*

BRUCE LEHMAN

*Attesting Officer*

*Commissioner of Patents and Trademarks*